US011657785B1

(12) United States Patent
Kerian

(10) Patent No.: US 11,657,785 B1
(45) Date of Patent: May 23, 2023

(54) HANDS FREE (MOUTH ALONE) DIATONIC HARMONICA AND IMPROVED HARMONICA MICROPHONE HOUSING

(71) Applicant: Paul Daniel Kerian, Valley Stream, NY (US)

(72) Inventor: Paul Daniel Kerian, Valley Stream, NY (US)

( * ) Notice: Subject to any disclaimer, the term of this patent is extended or adjusted under 35 U.S.C. 154(b) by 0 days.

(21) Appl. No.: 17/726,217

(22) Filed: Apr. 21, 2022

(51) Int. Cl.

| | |
|---|---|
| ***G10D 7/14*** | (2020.01) |
| ***G10D 9/02*** | (2020.01) |
| ***H04R 1/04*** | (2006.01) |
| ***H04R 1/08*** | (2006.01) |

(52) U.S. Cl.
CPC ..... *G10D 7/14* (2020.02); *G10D 9/02* (2013.01); *H04R 1/04* (2013.01); *H04R 1/08* (2013.01)

(58) Field of Classification Search
CPC ..... G10D 7/14; G10D 9/02; H04R 1/04
See application file for complete search history.

(56) References Cited

U.S. PATENT DOCUMENTS

| | | | | |
|---|---|---|---|---|
| 4,837,836 A * | 6/1989 | Barcus | ..... | H04R 1/08 84/723 |
| 7,847,172 B2 * | 12/2010 | Harrison | ..... | G10D 7/14 84/377 |
| 8,802,950 B2 * | 8/2014 | Bibollet | ..... | G10D 7/14 84/378 |
| 2016/0337736 A1 | 11/2016 | Grainger | | |

FOREIGN PATENT DOCUMENTS

| | | |
|---|---|---|
| CN | 203136099 U | 8/2013 |

* cited by examiner

*Primary Examiner* — Robert W Horn

(57) ABSTRACT

A hands-free diatonic harmonica configured to be held by the mouth only, permitting harmonica to be easily played and manipulated solely by player's mouth, jaw, teeth, lips, and tongue and attachable elongated ergonomic and acoustical bullet shaped harmonica microphone housing with mirror image top and bottom access ports and through rod(s) accommodating multiple microphones digital processing and adhesive pads providing or modifying mouth alone attributes.

6 Claims, 6 Drawing Sheets

HANDS FREE (MOUTH ALONE) DIATONIC HARMONICA AND IMPROVED HARMONICA MICROPHONE HOUSING

CROSS-REFERENCES TO RELATED APPLICATIONS

Not Applicable.

FIELD OF INVENTION

The present invention relates generally to an improved diatonic harmonica. More particularly, the present invention is related to an improved diatonic harmonica allowing hands and harness free or mouth alone operation of harmonica and an attached microphone housing for improve capture amplification and digital control of the harmonica and player's tones.

BACKGROUND OF THE INVENTION

The most popular and portable mouth harmonicas are the diatonic harmonicas. Diatonic harmonicas comprise a wood or plastic comb, a mouthpiece, a series of reeds mounted on top and bottom reed plates, and top and bottom metal cover plates. Most diatonic mouth harmonicas have 10 mouthpiece holes through which air can be inhaled or exhaled. Typically, the reed plates include 10 blow or exhale reeds mounted on the top reed plate and 10 draw or inhale mounted on the bottom reed plate. Each of the reeds are tuned to specific harmonious frequencies. The top and bottom cover plates cover the reed plates and are fastened together through the comb with multiple fasteners. Together, the two cover plates describe musical resonance chambers leading to the horn-like output end, from which the sound of the harmonica resonates.

It is possible to play a harmonica hands-free using harmonica holders suspended about the player's neck and shoulders that hold the harmonica to the player's mouth, leaving the player's hands free, for example, to simultaneously play a guitar or other instrument. However, if amplification is needed, existing hands-free methods present a problem. If played by hand, harmonica can simply hold a hand-held microphone to the horn-like output end of the harmonica or attach a purpose-built harmonica microphone to the horn-like output end. Typically, attached harmonica microphones physically encapsulate the output end of harmonica while other standard microphones are held next to the horn-like output end of a harmonica.

While attached harmonica microphones provide in some respects superior sound capture to hand-held or stand-held microphones they are generally not well suited to mouth-alone play and the capture of player's singing. Hands-free players are therefore restricted to the use of harness or stand-held microphones, limiting their ability to move around while performing and limiting the movement and mouth-alone playing and singing setups that can be used for performance.

Therefore, there exists a need for an improved harmonica optimized for hands-free play and designed for hands-free amplification with superior capture, transmission and amplification of musical tones, digital and analog processing acoustic effects and vocalizations.

SUMMARY OF THE INVENTION

This Summary is provided to introduce a selection of concepts in a simplified form that is further described below in the Detailed Description. This Summary is not intended to identify key features or essential features of the claimed subject matter, nor is it intended to be used as an aid in determining the scope of the claimed subject matter. The present invention is defined by the claims.

One or more embodiments of the present invention relate to a novel, improved diatonic harmonica allowing hands- and harness-free mouth-alone operation of harmonica. As used herein, the term "mouth only" operation refers to such hands- and harness-free operation. In particular, embodiments of the present invention are directed towards an improved harmonica that allows the user to play multiple octaves complex songs and chords while retaining, manipulating and orientating the harmonica using the player's teeth, tongue, mouth, lips and lower jaw movement alone.

Some embodiments of the present invention include an elongated bullet shaped harmonica microphone housing attached to the outboard output end of the harmonica to allow improved capture amplification and digital control of both harmonica tones and the player's vocalizations thru access doors top and bottom. Some embodiments may comprise adhesive pads configured to be placed upon harmonica to meet mouth-alone harmonica player's individual manipulation, orientation/indexing or retention needs. In some embodiments, such adhesive pads may be configured to retrofit existing harmonicas to enhance mouth alone capability.

BRIEF DESCRIPTION OF THE DRAWINGS

The present invention is described in detail below with reference to the attached drawing figures, wherein.

DETAILED DESCRIPTION OF THE INVENTION

Figure 1:
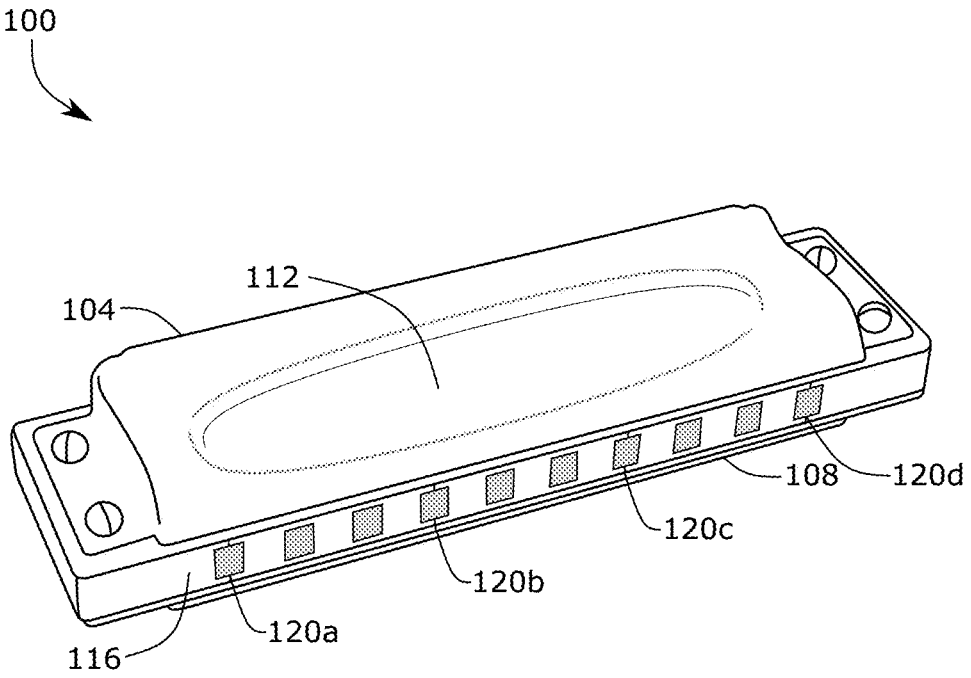
FIG. 1 provides an exemplary illustration of an isometric view of a diatonic mouth-alone harmonica according to embodiment of the present invention.

Some embodiments of the present invention are described with specificity herein to meet statutory requirements. However, the scope of the invention is not intended to be defined by the description itself. The claimed subject matter may be embodied as to include different features, elements, components, steps, or combinations of steps, similar to those described herein, and in combination with other existing or future technologies. Moreover, although the term "step" might be used to connote different elements of the methods employed, this term should not be interpreted as implying any particular order among or between various steps herein disclosed unless and except the order of individual steps is explicitly described or required.

One or more embodiments of the present invention relate to a novel, improved diatonic harmonica allowing hands- and harness-free operation, otherwise known as "mouth alone" operation, of harmonica. In particular, the present improved harmonica allows the user to play multiple octaves complex songs and chords while retaining, manipulating and orientating the harmonica using player's teeth, tongue, mouth, lips and lower jaw movement alone (hereinafter "mouth alone"). Mouth alone playing provides multiple benefits, including but not limited to freeing hands for other purposes, which can lead to increased available practice time and thus increasing playing skill, musical ear training, enhanced vocal breath support, and diaphragmatic breathing capability.

Some embodiments of the present invention include an elongated bullet shaped harmonica microphone housing to allow improved capture amplification and digital control of both harmonica tones and the player's vocalizations and hand movements thru access doors top and bottom. In some embodiments, microphones or pickups may be movably mounted on a thru rods spanning the interior of the microphone housing to enable variable positions of the microphones/pickups. In some embodiments, positioning of the microphones/pickups may be controlled manually via the access doors, while in other embodiments, the optimal positioning may be controlled passively, i.e. automatically, via servos within the microphone housing.

In some embodiments, the microphone housing may additionally contain circuitry which may comprise signal processors, transmitters, and digital and/or analog battery power. Some embodiments of the microphone housing may include circuitry to provide additional features which may comprise wireless blue tooth connectivity, digital or analog effects processing, and/or improved processing and/or amplification.

Some embodiments may comprise adhesive pads configured to meet mouth alone harmonica player's individual manipulation, orientation/indexing or retention needs. In some embodiments, such adhesive pads may be configured to retrofit existing harmonicas to enhance mouth alone capability.

Multiple microphones may be mounted on one or more adjustable thru rods inside the microphone housing, allowing one or more microphones to be moved with precision relative to the desired musical intervals being played.

The present invention provides mouth-alone/hands-free controllability improved harmonica convenience utility and versatility which may be complimented by attaching an elongated bullet shaped microphones housing with top and bottom access ports and through rods allowing one or more microphones to be moved to different musical intervals improving player's means to capture control and amplify harmonics overtones and resulting tones or where acoustical effects from hand movements or vocalizations offering improved means of harmonica and vocal tone capture, amplification, digital processing, wireless transmission and any other mouth alone convenience or capability which may be fit into microphone housing.

In some embodiments, the mouthpiece includes indexed octaves as indicated by tongue sensing and control attributes indexing and orienteering attributes. In some embodiments, the mouthpiece includes distinct or accentuated corners at the periphery of holes to allow greater tongue mouthpiece grip and indexing and orienteering details as pictured allowing player to feel octave intervals, retain manipulate and orient harmonica with tongue and mouth alone.

In some embodiments, the mouthpiece allows the tongue to move the harmonica in the players mouth due to the sharper edges on the holes themselves in addition to the lower cover plate tooth adhesion, allowing the player's tongue to remain in constant contact with the mouthpiece. Such play actually involves covering the two or three holes and either blowing or drawing on both sides of the tongue. This is known as the tongue blocking method and produces octaves and beautiful chords. Any tone generated by blowing in one hole can be replicated as a chord by blowing or drawing on both sides of the tongue with zero, one, two, or three middle holes fully or partially blocked and/or gripped and moved by the tongue and/or lower jaw movement.

FIG. 1 provides an exemplary illustration of an isometric view of a diatonic mouth-alone harmonica 100 according to embodiment of the present invention. As depicted, the harmonica comprises upper harmonica cover plate 104 and lower harmonica cover plate 108 that are acoustically and ergonomically fashioned with retention, orientation/indexing and maneuverability attributes facilitating mouth alone harmonica play. The upper harmonica cover plate 104 includes a smooth ergonomic depression 112 which allows the harmonic sliding under top teeth while held in the mouth of a user. The lower cover plate 108 may have an adhesive and/or fricative quality to allow the players bottom teeth to grip and/or adhere to it, thereby allowing the user to move the harmonica through lower jaw movement.

The mouthpiece 116 comprises reference points 120 *a-d* that may be indented or raised on mouthpiece enhancing tongue movement capability of harmonica and providing tactile indication the position of octaves that the player can feel with his tongue.

Figure 2:
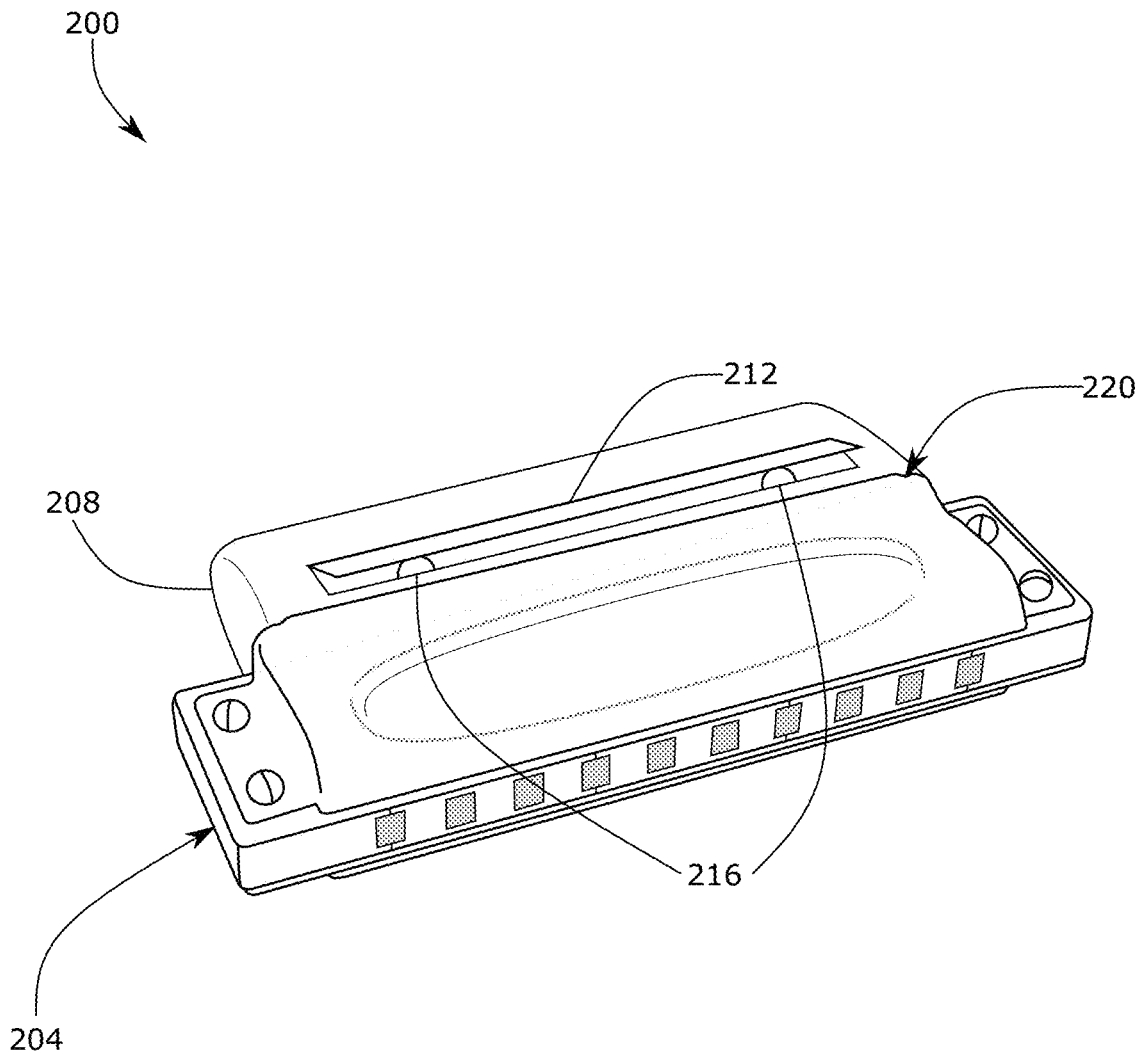
FIG. 2 provides an illustrative view of a mouth-alone harmonica with attached microphone housing according to embodiments of the present invention.

FIG. 2 provides an illustrative view 200 of a mouth-alone harmonica 204 with attached microphone housing 208 according to embodiments of the present invention. As depicted, the microphone housing 208 has an elongated, bullet-shape with an open upper access panel 212 to afford tactile and visual access to one or more digital control knobs and/or moveably situated microphones 216 on one or more through rods and digital controls (not shown). Upper access panel 212 may be closable.

As depicted, microphone housing 208 is attached to and substantially encloses the horn-like distal end of the harmonica 220. In addition to upper access panel 212, microphone housing 208 may include a lower access panel (not shown), the upper and lower access doors being configured to permit access to the horn-like distal end of the harmonica 220 and to provide access to one or more microphones 216 and/or instrumental pick-ups which may be repositioned and/or re-orientated on one or more through rods (not shown) spanning the length of the microphone housing 208 situated and attached to harmonica to capture harmonica and harmonica player tonal output.

The novel elongated bullet-shaped ergonomically and acoustically shaped microphone housing 208 improves the player's ability to capture, transmit, process and amplify complex varied chords and harmonics, as well as overtones and resulting tones where multiple reeds are excited while providing improved capture of vocalizations.

Figure 3A:
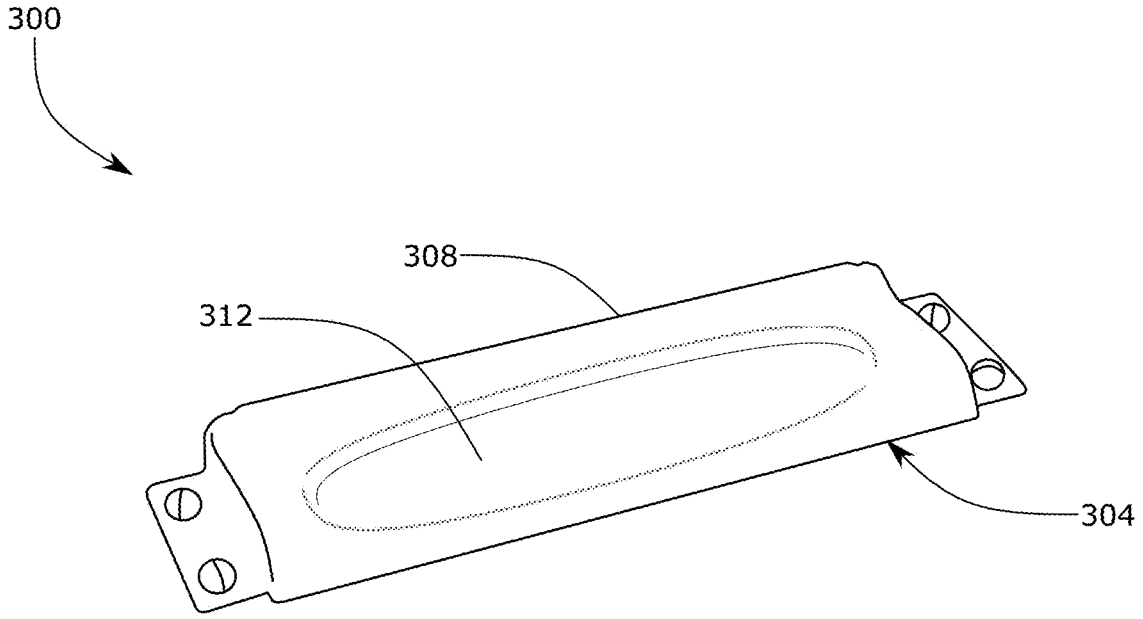
FIG. 3A provides a detail view of an exemplary embodiment of a top cover plate according to aspects of the present invention.

FIG. 3A provides a detail view 300 of an exemplary embodiment of a top cover plate 304 according to aspects of the present invention. As depicted, the top cover plate 304 includes an ergonomic and acoustic horn-like output end portion 308 and a smooth sliding depression 312 near the mouthpiece configured to provide retention, and orientation/ indexing to aid in mouth-alone playing. The smooth sliding depression 312 may allow the harmonica to more easily slide from side to side under top teeth of a user.

Figure 3B:
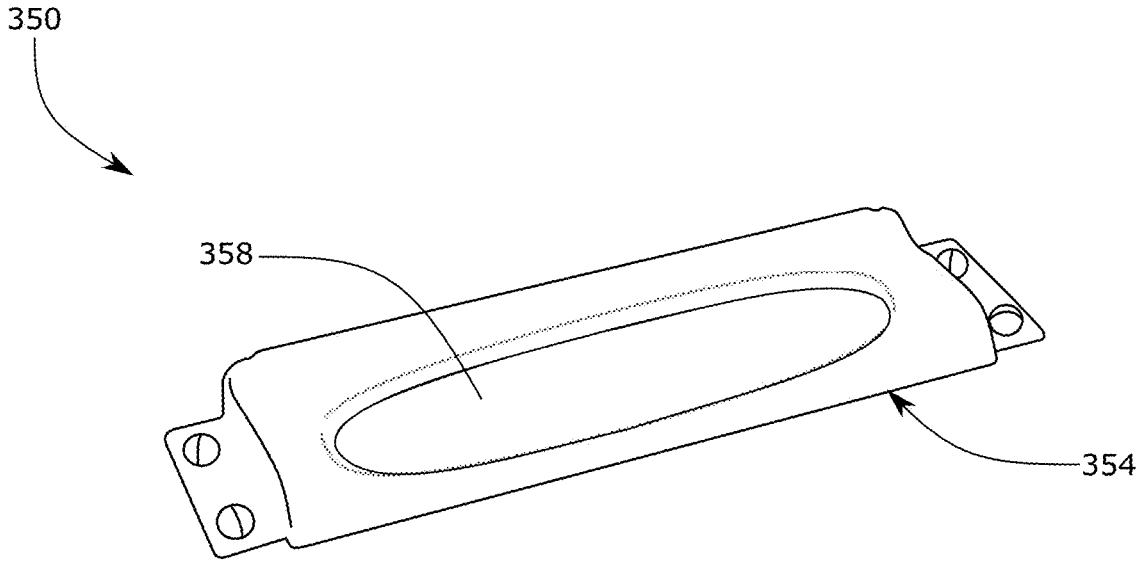
FIG. 3B provides a detail view of an exemplary embodiment of a bottom cover plate according to aspects of the present invention.

FIG. 3B provides a detail view 350 of an exemplary embodiment of a bottom cover plate 354 according to aspects of the present invention. As depicted, bottom cover plate 354 includes an indented and textured surface 358 configured to allow lower jaw and teeth to move harmonica from side to side and in and out of players mouth with retention maneuverability means on bottom cover plate. Thus, the harmonica to perch with the player's bottom teeth in indented and textured surface 358 while being able to be manipulated in and out and from side-to-side by the players lower jaw movement.

Figure 4:
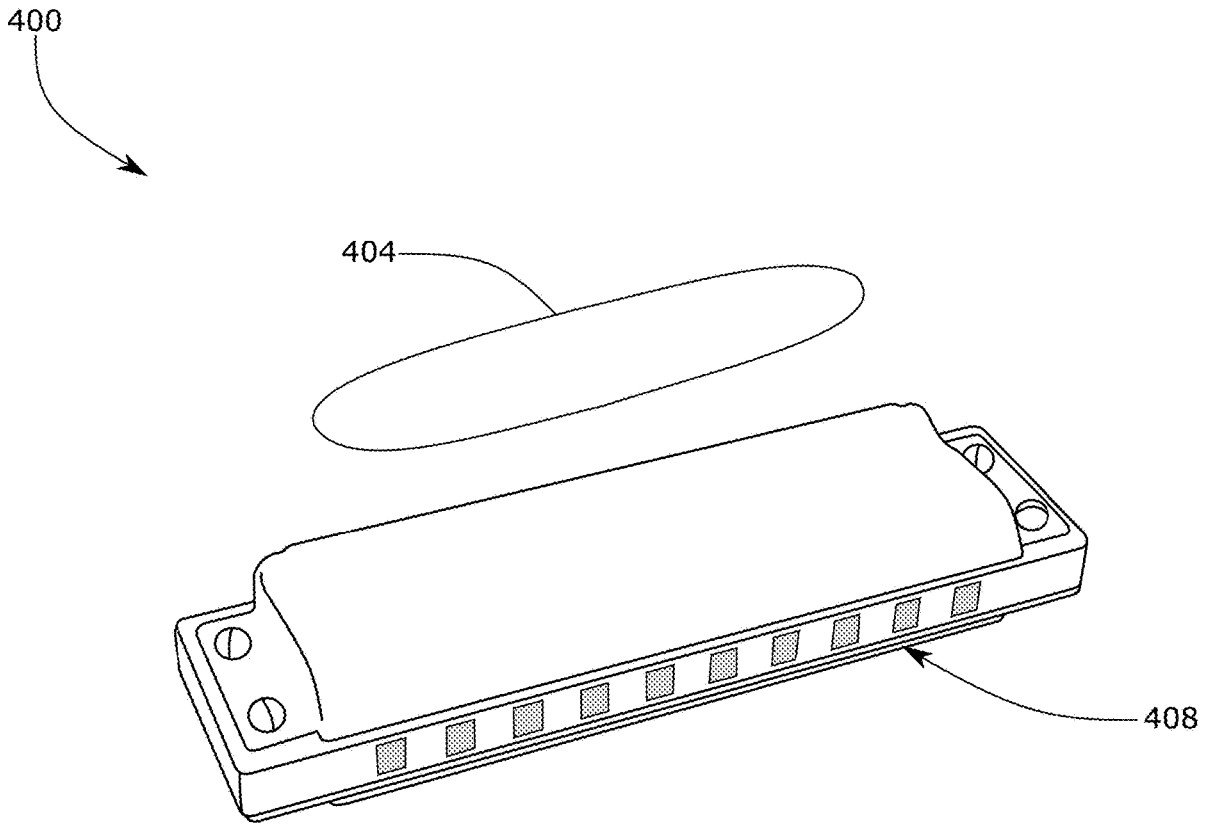
FIG. 4 depicts an exemplary embodiment of mouth alone harmonica adhesive pads according to aspects of the present invention.

FIG. 4 provides a prospective view 400 depicting an exemplary embodiment of mouth-alone harmonica adhesive pads 404 according to aspects of the present invention. The adhesive pads 404 depicted may allow mouth alone capability to be added to existing harmonica 408. In some embodiment, adhesive pads 404 may be added to mouth-alone harmonica where players wish to avoid metal to tooth contact or where mouth-alone harmonica player has unique retention, indexing/orientation and/or maneuverability requirements.

Figure 5:
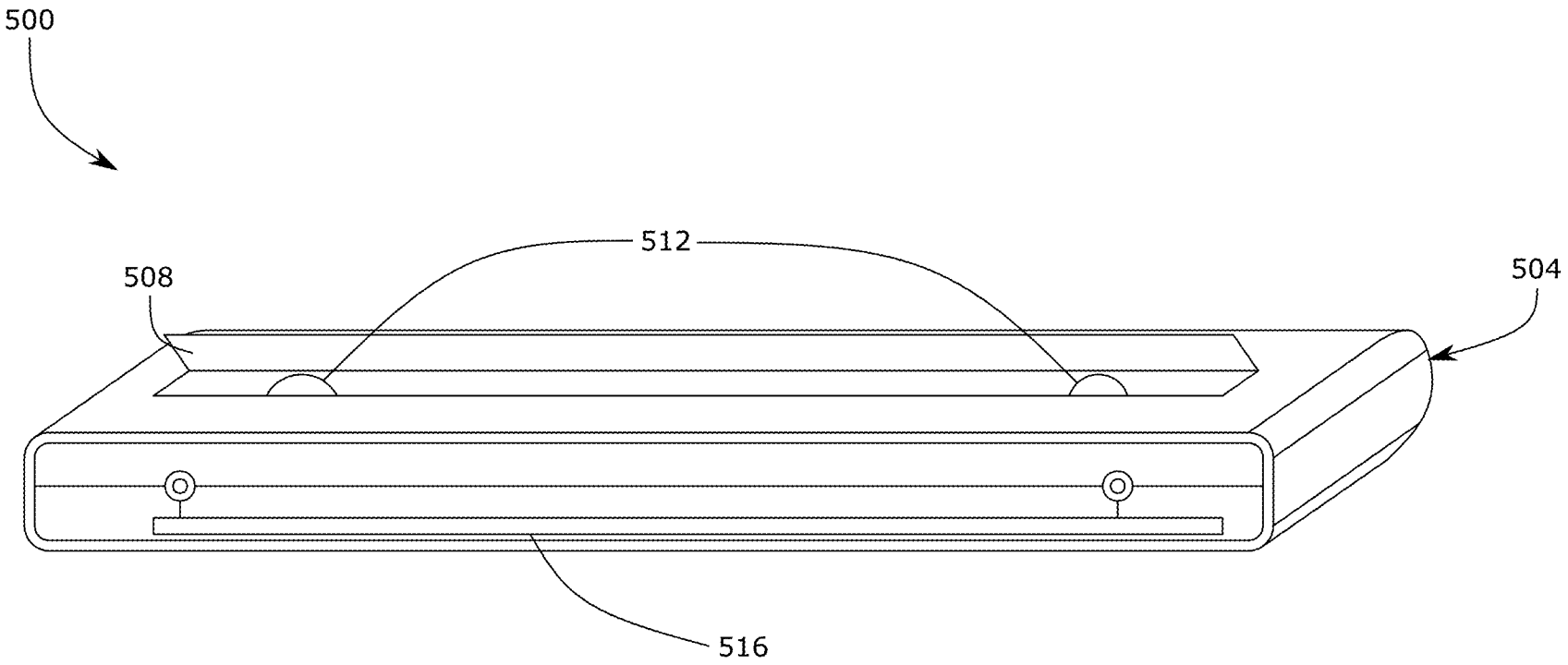
FIG. 5 provides a prospective view of an embodiment of a microphone housing in accordance with aspects of the present invention.

FIG. 5 provides a prospective view 500 of an embodiment of a microphone housing 504 in accordance with aspects of the present invention. As depicted, microphone housing 504 is removed from the harmonica (not shown), permitting the harmonic facing components to be more clearly viewed. Microphone housing 504 includes upper access door 508 configured to permit access to the horn-like distal end of the harmonica (not shown) and to provide access to one or more microphones and/or instrumental pick-ups 512 which may be repositioned and/or re-orientated on one or more through rods 516 spanning the length of the microphone housing 504 situated and attached to harmonica to capture harmonica and harmonica player tonal output.

Figure 6:
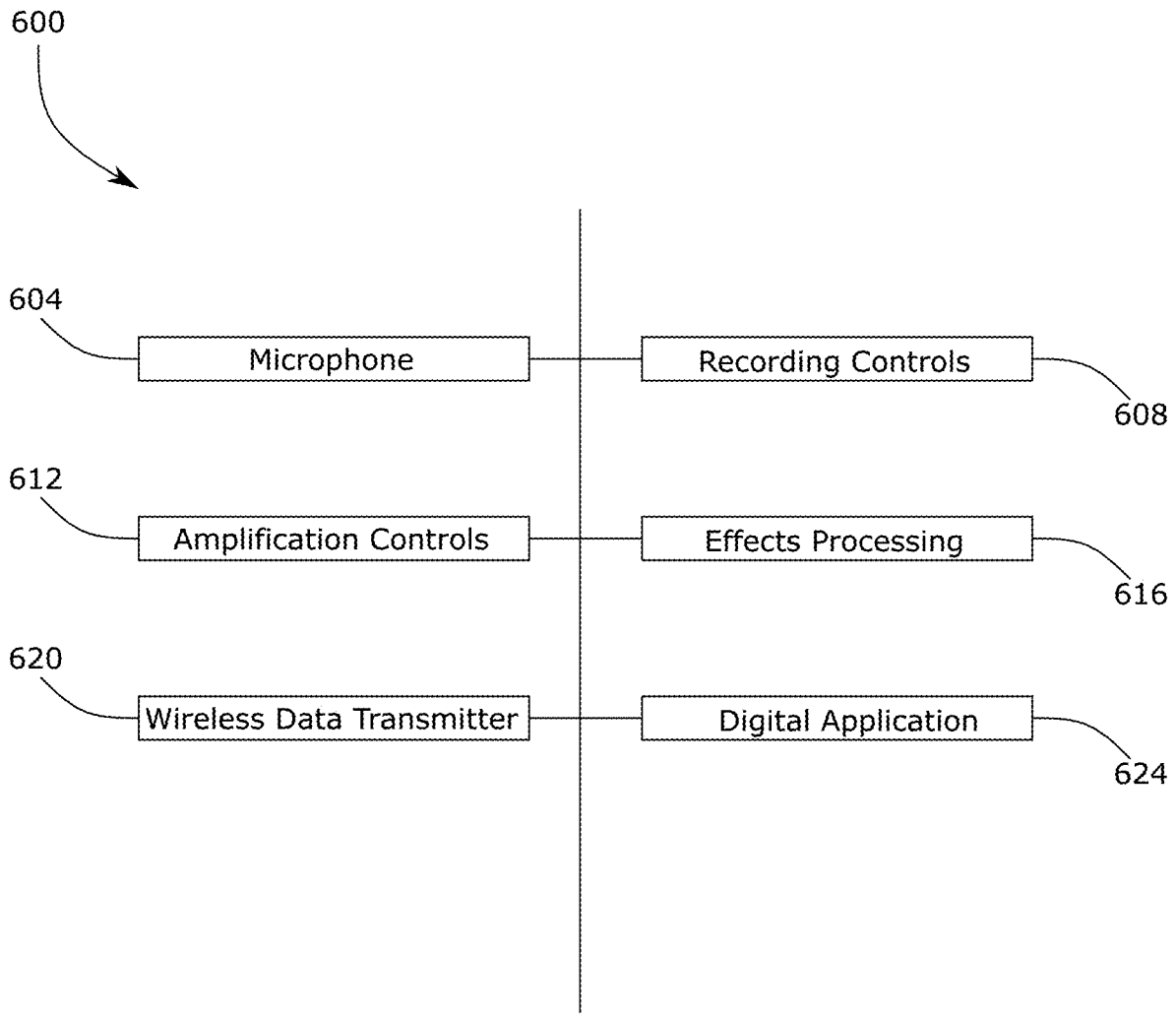
FIG. 6 provides a system diagram describing an exemplary embodiment in accordance with aspects of the present invention.

The bullet-shaped microphone housing may house various digital enhancements such as those available on cell phones; cameras, Bluetooth etc. FIG. 6 provides a system diagram 600 describing an exemplary embodiment in accordance with aspects of the present invention. As depicted, the system includes one or more microphones or pick-ups 604, controls for recording 608, amplification 612, effects processing 616, wireless data transmitter 620 and digital appliances 624 housed within the elongated bullet shaped harmonica microphone housing. Digital appliances may include but are not limited to a looper, special effects digital camera or the like.

Embodiments of the present invention have been described, as required by statute, to be illustrative, but should not be interpreted to be restrictive. One having skill in the art will recognize that many different arrangements of the various components depicted are possible without departing from the scope of the claims below, as well as arrangements including components not explicitly shown.

One having skill in the art will understand that certain combinations and/or sub-combinations of elements and features are of utility and may be employed without reference to other combinations and/or sub-combinations and are contemplated within the scope of the claims. Not all steps listed in the various figures need be carried out in the specific order described.

What is claimed is:

1. A mouth harmonica comprising:
a mouthpiece;
a horn-like output end opposite the mouthpiece;
a top cover plate having a slight indentation and a smooth surface,
wherein the slight indentation is configured to aid retention and movement of the mouth harmonica by a user's upper teeth,
wherein the smooth surface is configured to easily slide under the user's upper teeth; and
a bottom cover plate having an enhanced surface,
wherein the enhanced surface comprises at least one of a contoured, frictious, abrasive, and adhesive character,
wherein the enhanced surface is configured to allow the user's lower teeth to grip and manipulate the mouth harmonica in and out and from side to side while being retained and played using the user's lower jaw teeth and mouth alone.

2. The mouth harmonica of claim 1, wherein:
the mouthpiece has tactile references and control points,
wherein the tactile references and control points are configured to allow the user's tongue to move harmonica in players mouth and detect position and orientation and re-position harmonica using the mouthpiece.

3. The mouth harmonica of claim 1, further comprising:
a microphone housing attached to and substantially enclosing the horn-like output end,
wherein the microphone housing has an outboard aspect, the outboard aspect having a generally elongated, rounded, bullet-like shape.

4. The mouth harmonica of claim 1, wherein:
the microphone housing has one or more upper access door and one or more lower access doors, the upper and lower access doors being configured to permit access to the horn-like output end and to provide access to one or more control knobs and one or more microphones which may be repositioned and/or re orientated on one or more through rods spanning the length of the microphone housing situated and attached to harmonica to capture harmonica and harmonica player's tonal output and allow enhanced capture of hand movement acoustical effects and player vocalizations.

5. The mouth harmonica of claim 1, wherein:
the hands-free (mouth alone) harmonica comprises adhesive pads for placement on prior art harmonica cover plates and/or mouthpiece affording or supplementing harmonica's mouth alone retention, maneuverability and indexing/orientation means.

6. The mouth harmonica of claim 1, wherein:
the hands-free (mouth alone) harmonica retention, manipulation, indexing and orientation attributes are modified or supplemented by adhesive pads to meet specific individual player needs or requirements such as where harmonica player is averse to tooth to metal contact.

* * * * *